US011273563B2

(12) United States Patent
Paspatis

(10) Patent No.: US 11,273,563 B2
(45) Date of Patent: Mar. 15, 2022

(54) SELF-MOVABLE BLADE SUPPORTS

(71) Applicant: Bic Violex S.A., Anixi (GR)

(72) Inventor: Georgios Paspatis, Tripoli (GR)

(73) Assignee: Bic Violex S.A., Anixi (GR)

( * ) Notice: Subject to any disclaimer, the term of this patent is extended or adjusted under 35 U.S.C. 154(b) by 170 days.

(21) Appl. No.: 16/526,194

(22) Filed: Jul. 30, 2019

(65) Prior Publication Data

US 2021/0031387 A1 Feb. 4, 2021

(51) Int. Cl.

| | |
|---|---|
| ***B26B 21/22*** | (2006.01) |
| ***B26B 21/40*** | (2006.01) |
| ***B26B 21/52*** | (2006.01) |
| *B26B 21/44* | (2006.01) |
| *B26B 21/56* | (2006.01) |

(52) U.S. Cl.

CPC ..... *B26B 21/227* (2013.01); *B26B 21/4012* (2013.01); *B26B 21/521* (2013.01); *B26B 21/225* (2013.01); *B26B 21/443* (2013.01); *B26B 21/565* (2013.01)

(58) Field of Classification Search

CPC . B26B 21/227; B26B 21/4012; B26B 21/225; B26B 21/521; B26B 21/443; B26B 21/565

USPC ..... 30/50

See application file for complete search history.

(56) References Cited

U.S. PATENT DOCUMENTS

| | | | | |
|---|---|---|---|---|
| 4,720,917 | A * | 1/1988 | Solow | B26B 21/4012 30/346.5 |
| 4,754,548 | A * | 7/1988 | Solow | B26B 21/4006 30/32 |
| 7,748,121 | B2 | 7/2010 | Coffin | |
| 8,234,789 | B2 * | 8/2012 | Avens | B26B 21/443 30/50 |
| 8,336,212 | B2 | 12/2012 | Bozikis et al. | |
| 9,789,618 | B2 | 10/2017 | Bozikis et al. | |
| 9,862,108 | B2 | 1/2018 | Davos et al. | |
| 10,220,532 | B2 | 3/2019 | Davos et al. | |
| 2007/0028449 | A1 * | 2/2007 | King | B26B 21/528 30/49 |
| 2017/0106549 | A1 | 4/2017 | Bozikis et al. | |

FOREIGN PATENT DOCUMENTS

| | | | |
|---|---|---|---|
| WO | 2018141605 | A1 | 8/2018 |

* cited by examiner

*Primary Examiner* — Omar Flores Sanchez

(74) *Attorney, Agent, or Firm* — Bookoff McAndrews, PLLC

(57) ABSTRACT

A shaving blade member may include a first portion disposed in a first plane, wherein an end of the first portion includes a tapered cutting edge; a second portion extending from the first portion and disposed in a second plane, the second plane being at an angle with the first plane; wherein the second portion comprises one or more protrusions, the one or more protrusions being movable relative to the second portion.

16 Claims, 18 Drawing Sheets

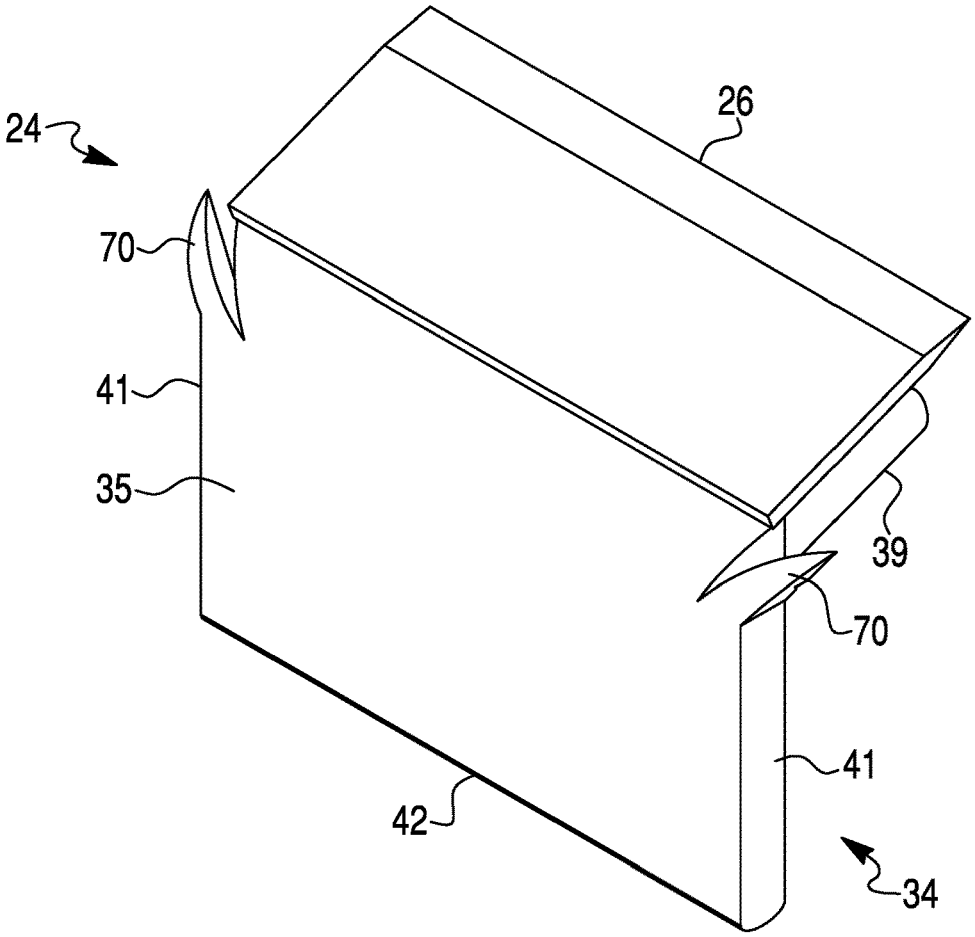
FIG. 7
FIG. 7A
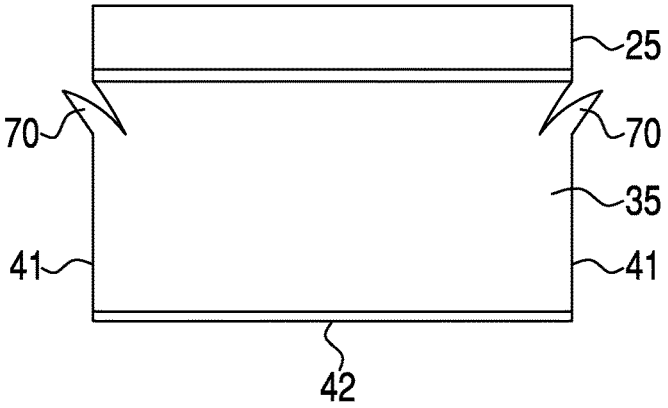

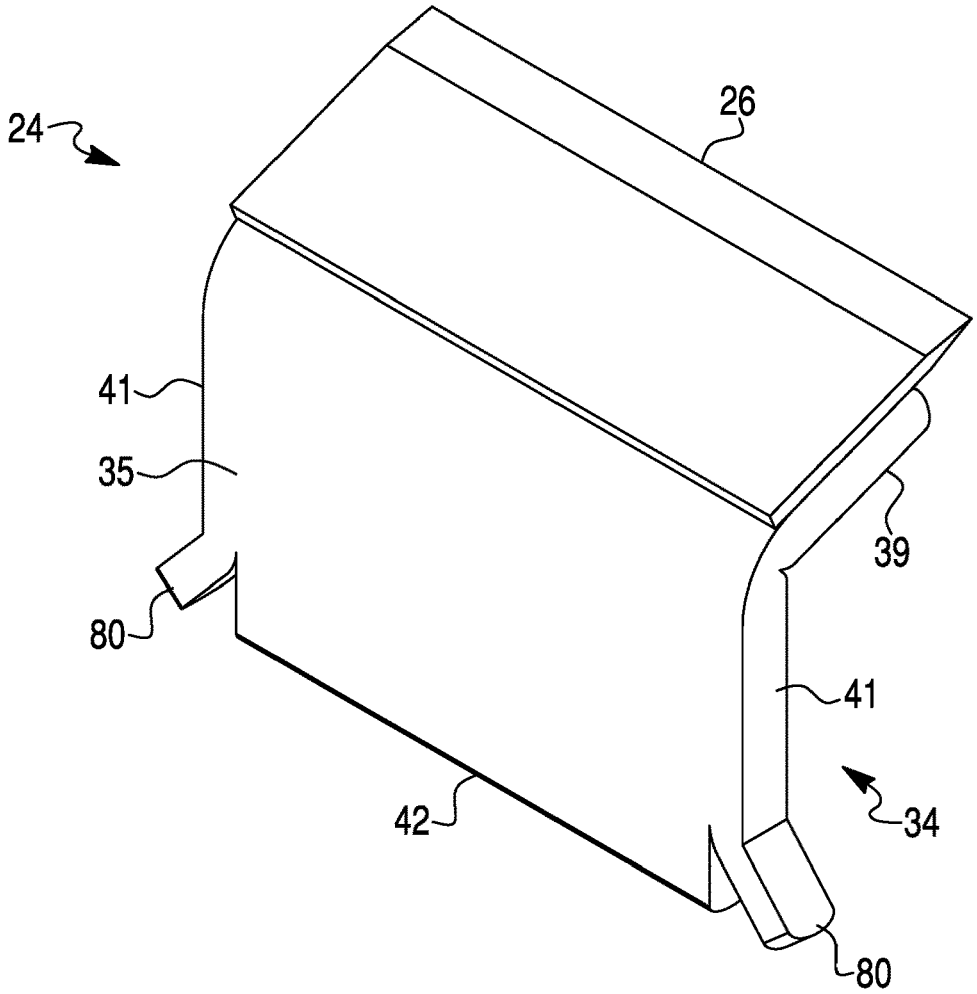
FIG. 8
FIG. 8A
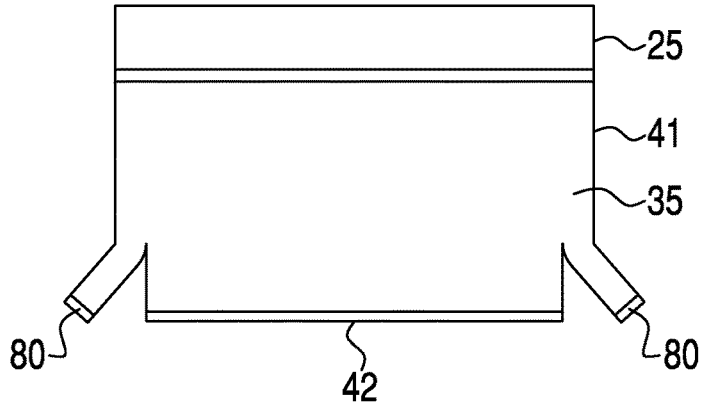

FIG. 9
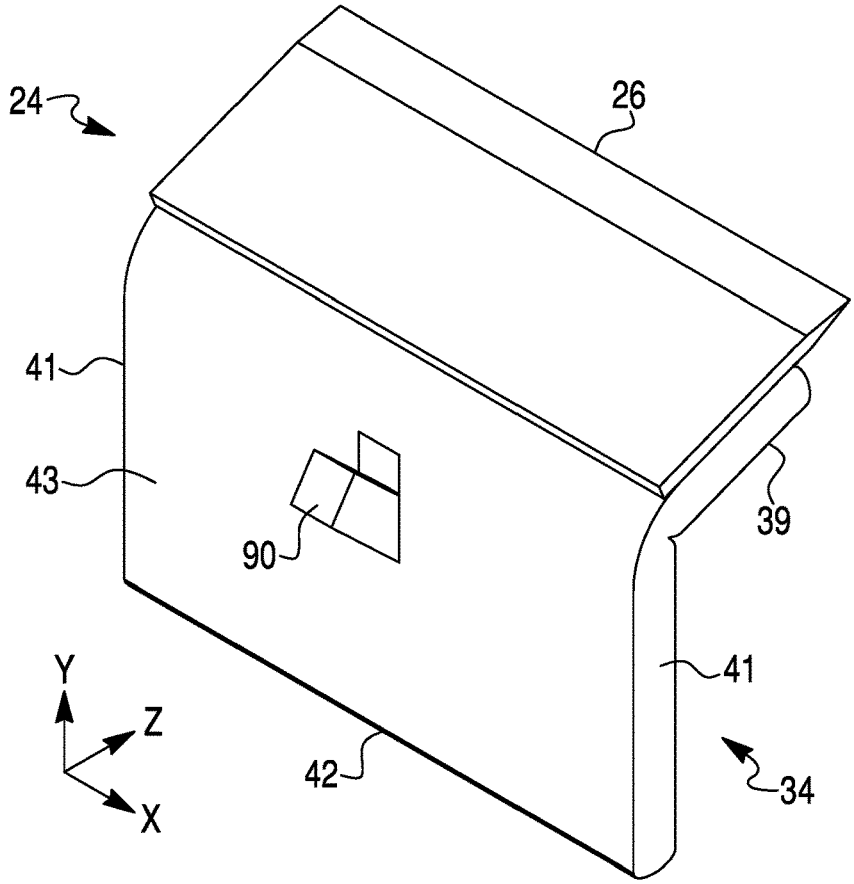
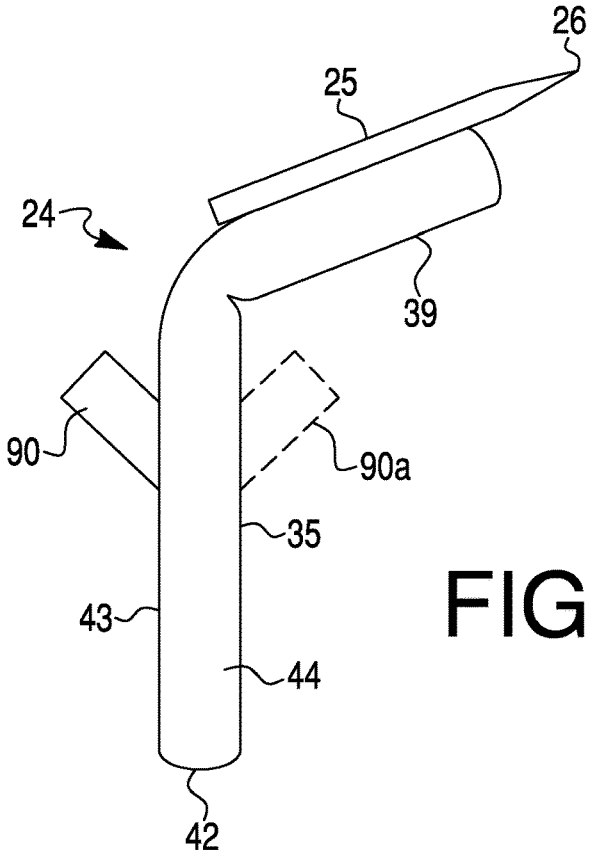
FIG. 9A

FIG. 10
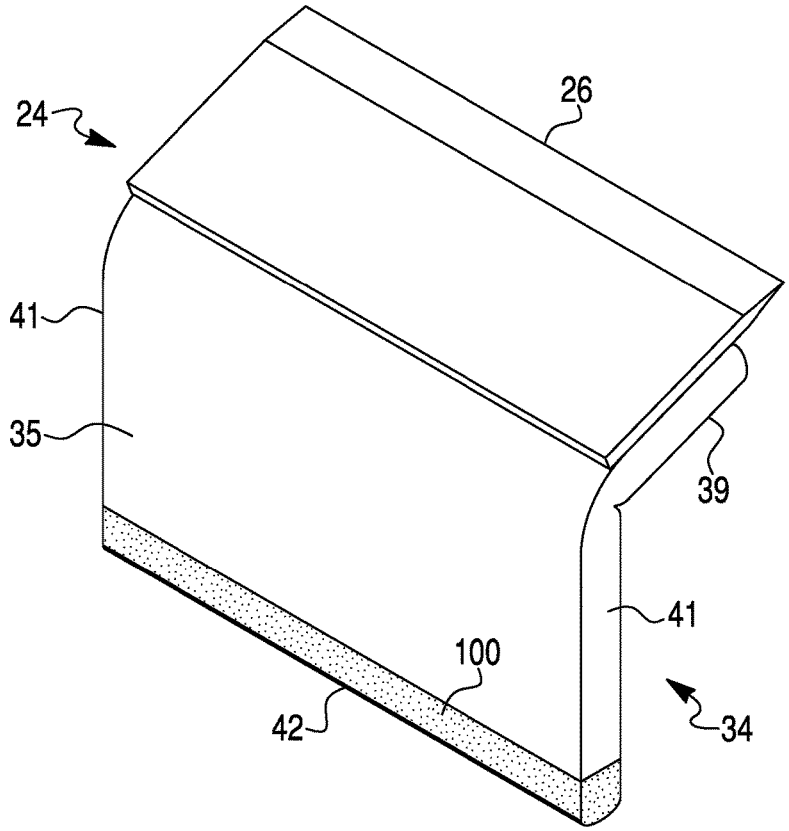
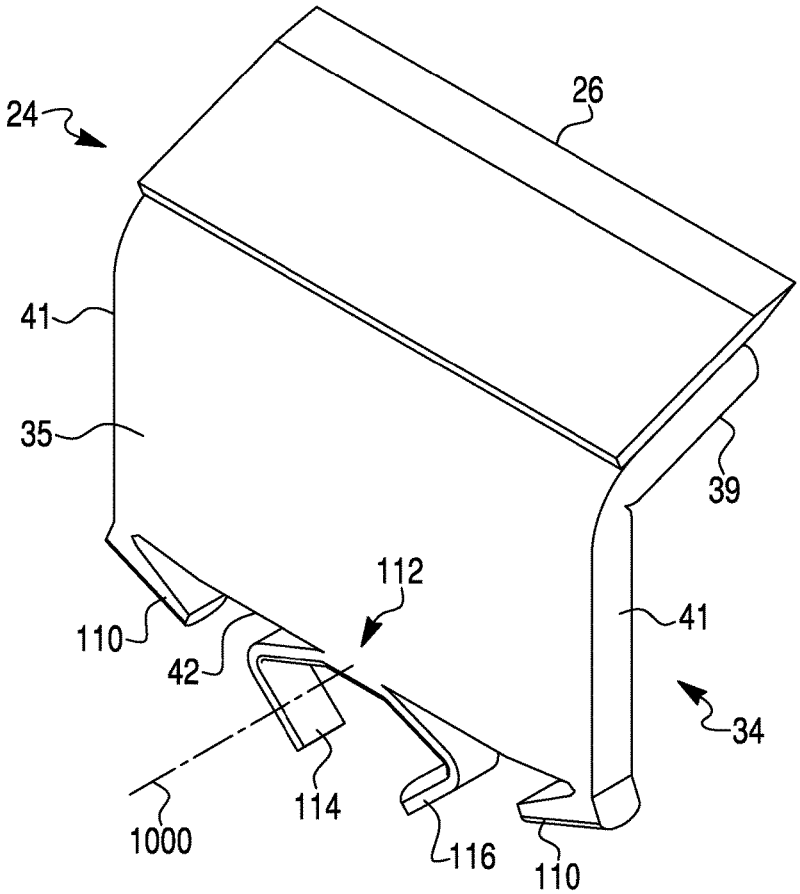
FIG. 11

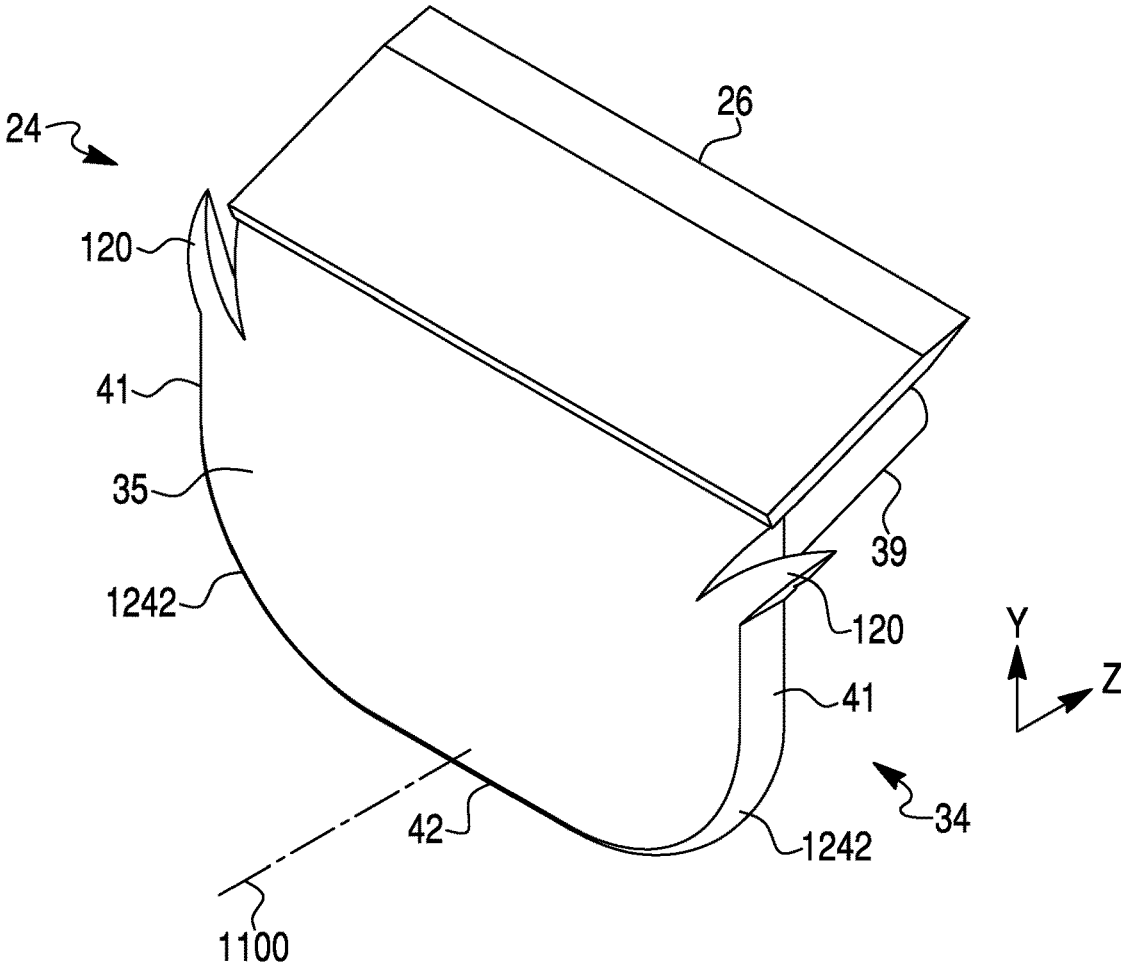
FIG. 12
FIG. 12A
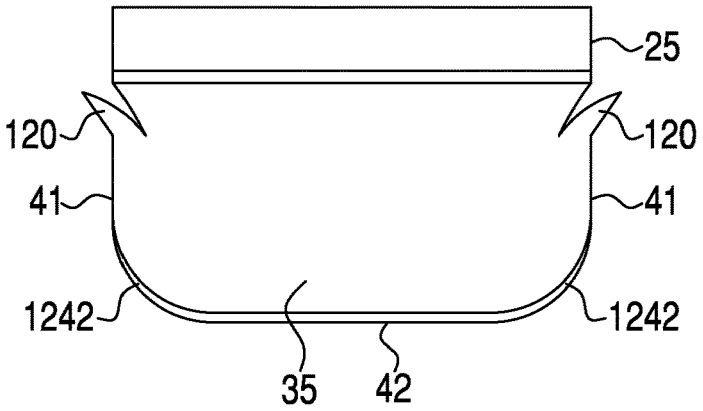

SELF-MOVABLE BLADE SUPPORTS

TECHNICAL FIELD

Aspects of the present disclosure relate generally to self-movable blade supports for a shaver.

DESCRIPTION OF RELATED TECHNOLOGY

Some shaver blade assemblies are made by welding a flat blade to an upper flat portion of an L-shaped metal blade support. Shaver heads for holding the blade assemblies often include spring fingers, located underneath the supports or underneath the blade itself. The spring fingers enable movement of the blade assemblies relative to a shaver head that receives the blade assemblies. However, these spring fingers also trap shaving debris within the shaving head, even after rinsing of the shaver head. Therefore, blade assembly lifetime and shaver hygiene/cleanliness are reduced. In addition, the use of spring fingers complicates shaver head design and increases manufacturing time and cost.

SUMMARY

In one aspect, this disclosure is directed to a shaving blade member, comprising a first portion disposed in a first plane, wherein an end of the first portion includes a tapered cutting edge; a second portion extending from the first portion and disposed in a second plane, the second plane being at an angle with the first plane; wherein the second portion comprises one or more protrusions, the one or more protrusions being movable relative to the second portion.

In another aspect, this disclosure is directed to a shaving blade member, comprising: a first portion disposed in a first plane, wherein an end of the first portion includes a tapered cutting edge; a second portion extending from the first portion and disposed in a second plane being at an angle with the first plane, the second portion including a bottom edge that is substantially parallel to the tapered cutting edge, wherein the second portion is formed from a first material; and a second material extending along at least a portion of the bottom edge, wherein the second material has a greater elasticity than the first material.

In yet another aspect, this disclosure is directed to a shaver, comprising: a handle; a head coupled to the handle, wherein the head comprises a frame; and one or more shaving blade members coupled to the frame, wherein each of the one or more shaving blade members includes: a first portion disposed in a first plane, wherein an end of the first portion includes a tapered cutting edge; and a second portion extending from the first portion and disposed in a second plane being at an angle with the first plane; and one or more protrusions that are movable relative to the second portion, the one or more protrusions are configured to be coupled to the frame, such that the first portion and the second portion are movable relative to the frame once the protrusions are coupled to the frame.

BRIEF DESCRIPTION OF THE DRAWINGS

The accompanying drawings, which are incorporated in and constitute a part of this disclosure, illustrate various exemplary embodiments and together with the description, serve to explain the principles of the disclosure.

Aspects of the disclosure may be implemented in connection with embodiments illustrated in the attached drawings. These drawings show different aspects of the present disclosure and, where appropriate, reference numerals illustrating like structures, components, materials and/or elements in different figures are labeled similarly. It is understood that various combinations of the structures, components, and/or elements, other than those specifically shown, are contemplated and are within the scope of the present disclosure. There are many aspects and embodiments described herein. Those of ordinary skill in the art will readily recognize that the features of a particular aspect or embodiment may be used in conjunction with the features of any or all of the other aspects or embodiments described in this disclosure.

FIG. 7 is a perspective view of another exemplary blade member.

FIG. 7A is a rear view illustration of the blade member of FIG. 7.

FIG. 8 is a perspective view of another exemplary blade member.

FIG. 8A is a rear view illustration of the blade member of FIG. 8.

FIG. 9 is a perspective view of another exemplary blade member.

FIG. 9A is side view of the blade member of FIG. 9.

FIG. 10 is a perspective view of another exemplary blade member.

FIG. 11 is a perspective view of another exemplary blade member.

FIG. 12 is a perspective view of another exemplary blade member.

FIG. 12A is rear view illustration of the blade member of FIG. 12.

DETAILED DESCRIPTION

Both the foregoing general description and the following detailed description are exemplary and explanatory only and are not restrictive of the features, as claimed. As used herein, the terms "comprises," "comprising," or other variations thereof, are intended to cover a non-exclusive inclusion such that a process, method, article, or apparatus that comprises a list of elements does not include only those elements, but may include other elements not expressly listed or inherent to such a process, method, article, or apparatus. Additionally, the term "exemplary" is used herein in the sense of "example," rather than "ideal." It should be noted that all numeric values disclosed or claimed herein (including all disclosed values, limits, and ranges) may have a variation of +/−10% (unless a different variation is specified) from the disclosed numeric value. Moreover, in the claims, values, limits, and/or ranges mean the value, limit, and/or range +/−10%. As used herein, the terms "about," "substantially," and "approximately," indicate a range of values within +/−10% of the stated value. Furthermore, the term "about equal" used to compare different values may mean that the values are within +/−10% of one another.

The present disclosure is related to movable blade supports that comprise one or more elastic elements configured to enable movement of shaver blades relative to a shaver head frame, after the shaver blades are installed into the shaver head frame. The elastic elements may include, e.g., protrusions or otherwise elastic/flexible material disposed along the periphery of the blade support. The blade supports disclosed herein may help simplify the design of shaving heads and shavers, resulting in shorter and lower-cost manufacturing processes. Furthermore, the blade supports of the present disclosure may improve the rinsability of shaver heads that incorporate the blade supports, because there may be no need for separate spring fingers that extend directly from the shaver head frame itself. The separate spring fingers of existing shavers are often positioned underneath the blades (away from the blade surface that comes in contact with skin during shaving), and block/trap shaving debris within the shaver head frame, even after rinsing of the shaver. Thus, in some embodiments, shaver heads of the present disclosure will not include any springs or otherwise elastic elements or configurations that secure the blade supports or blades to the shaver head frame.

Figure 1:
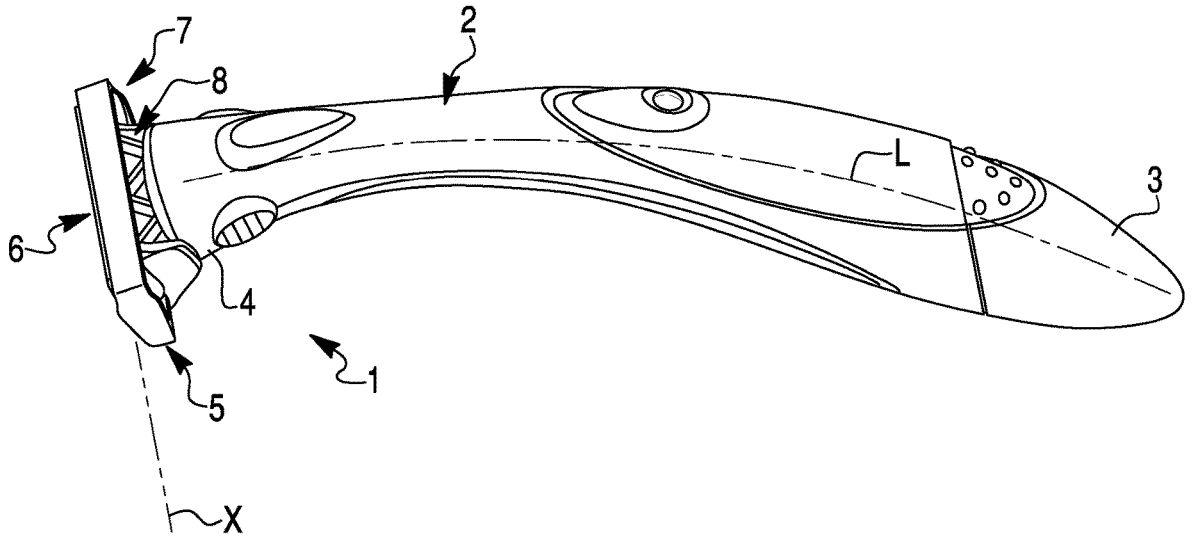
FIG. 1 is a perspective view of a shaver.

FIG. 1 shows a shaver 1 (e.g., a safety razor) suitable for wet shaving. Shaver 1 may include a handle 2 extending along a longitudinal direction L between a proximal portion 3 and a distal portion 4. A blade unit 5 or shaver head may be positioned at distal portion 4. The longitudinal direction L may be curved or include one or more straight portions.

Blade unit 5 may include an upper face 6 equipped with one or more blades, and a lower face 7 which is coupled to distal portion 4 of handle 2 by a connection mechanism 8. Connection mechanism 8 may for instance enable blade unit 5 to pivot relative to a pivot axis X, which is substantially perpendicular to the longitudinal direction L. Connection mechanism 8 may further enable selective release of blade unit 5 for the purpose of exchanging blade units.

Figure 2:
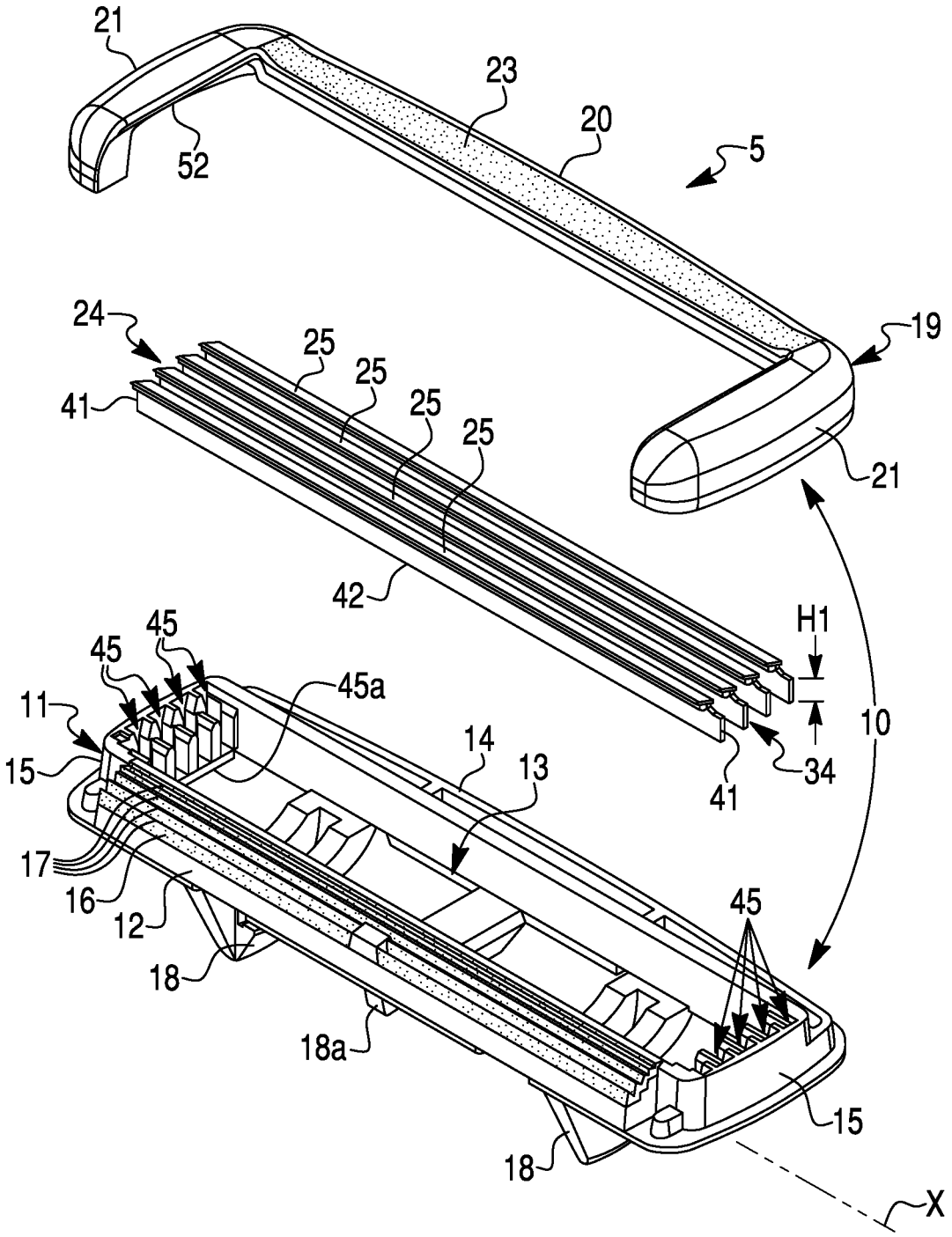
FIG. 2 is an exploded perspective view of a blade unit/head of the shaver of FIG. 1.

As shown in FIG. 2, blade unit 5 may include a shaver head frame 10 having one or more plastic, metal, and/or elastomeric materials. For example, shaver head frame 10 may include a plastic platform member 11 coupled to handle 2 by connection mechanism 8, and may also include a guard 12 extending substantially parallel to pivot axis X. Blade unit 5 may pivot or move about pivot axis X during shaving, for example, to adjust to the contours of the face or body of a user. Shaver head frame 10 may also include a blade receiving section 13 positioned rearward of guard 12 in the direction of shaving. Shaver head frame 10 may also include a cap 14 extending substantially parallel to pivot axis X and situated rearward of the blade receiving section 13 in the direction of shaving. Shaver head frame 10 may also include two side members 15 joining the longitudinal ends of guard 12 and of cap 14 together. Guard 12 may be covered by an elastomeric material 16 forming a plurality of fins 17 extending substantially parallel to pivot axis X. Elastomeric material 16 may include four fins 17, although other suitable numbers of fins (e.g., one, two, three, or five or more), or no fins at all, also are contemplated.

Further, an underside of platform member 11 may include two shell bearings 18 of connection mechanism 8. The underside of platform 11 may also include a support 18*a*, which may include one or more recesses (not shown) configured to receive a protrusion of a blade member 24 as discussed in further detail below. Shaver head frame 10 may include a plastic cover 19, which exhibits a generally U-shaped configuration, with a cap 20 partially covering cap 14 of platform 11. Shaver head frame 10 may include two side members 21 covering the two side members 15 of platform 11. The cap 20 of the plastic cover 19 forms, with cap 14 of the platform 11, a combined cap which comes into contact with the skin of the user during shaving. Cap 20 of cover 19 may include a lubricating strip 23 which is oriented upward and comes into contact with the skin of the user during shaving. Lubricating strip 23 may be formed for instance by co-injection with the rest of cover 19.

Side members 21 of cover 19 form, together with the side members 15 of platform 11, two side portions of shaver head frame 10, joining guard 12 to the combined cap. Cover 19 may be coupled to platform 11 by any known means, for instance by ultrasound welding, laser welding, snap-fit, press-fit or any similar coupling mechanism. An inner face of each side member 15 may include one or more slots 45 for receiving a support 34, as set forth below. Furthermore, each side member 15 may include a surface 45*a* underneath slots 45 to close the end of slots 45 closest to handle 2. Surface 45*a* may serve as stop for blade members 23 disposed within each slot 45.

Blade receiving section 13 may include several blade members 24, for instance four blade members 24, as in the example shown in FIG. 2. However, other numbers of blade members 24 are also contemplated, including, e.g., one, two, three, or five or more.

Figure 3:
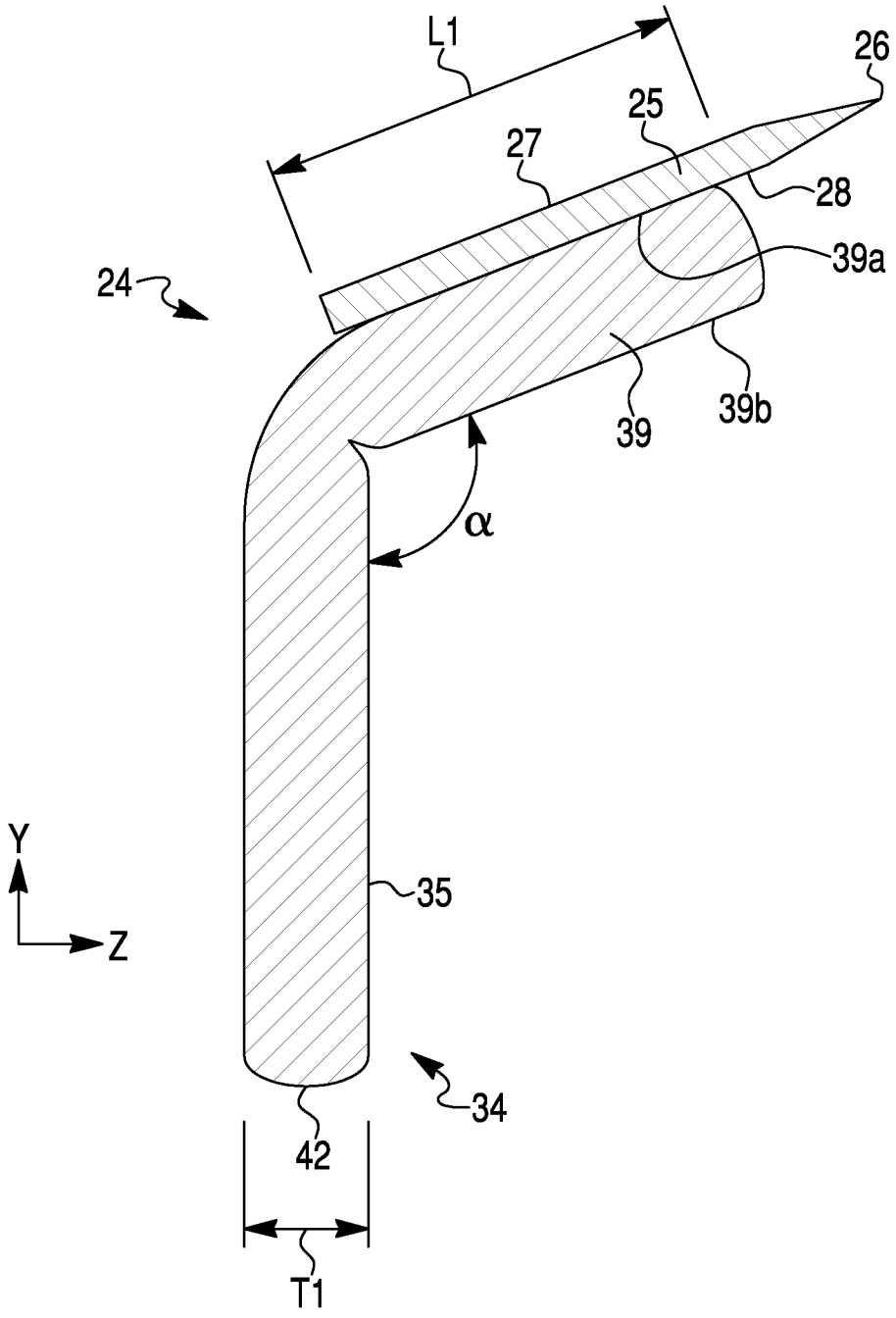
FIG. 3 is a side cross-sectional view of an exemplary blade member.

FIG. 3 illustrates a cross-section of an exemplary blade member 24, which may be movably mounted in blade receiving section 13 of shaver head frame 10. Each blade member 24 may include a straight blade 25, which may be formed by a flat metal (e.g., steel) strip with a cutting edge 26 oriented forward in the direction of shaving. Each blade 25 may include an upper face 27 oriented towards the skin to be shaved and an opposing lower face 28, oriented, for example, toward handle 2. The upper and lower faces 27, 28 of the blade 25 may be substantially parallel to one another, and may taper towards cutting edge 26.

Each blade 25 extends longitudinally, parallel to pivot axis X, between two lateral edges 41 (referring to FIG. 2). A length between the two lateral edges 41 may be, for example, from about 25.0 mm to about 50.0 mm, or from about 30.0 mm to about 45.0 mm, or from about 35.0 mm to about 40.0 mm. In one embodiment, a length between the two lateral edges 41 may be about 38.35 mm. Each blade 25 may be coupled to a bent support 34. Bent support 34 may include a bent profile including a substantially flat lower portion 35 that is substantially perpendicular and extends along or substantially parallel to a Y axis, and a substantially flat upper portion 39 which extends substantially parallel to a straight blade 25 (along the X axis). Lower portion 35 may have a height H1 (shown in FIG. 2), for example, from about 0.50 mm to about 1.50 mm, or about 1.00 mm to about 1.40 mm, or about 1.10 mm to about 1.35 mm, or about 1.20 mm to about 1.30 mm, about 1.21 mm, or about 1.22 mm. or about 1.23 mm, about 1.24 mm, or about 1.25 mm. Bent support 34 may be formed from any suitable material, such as, e.g., steel sheet metal, other metals, polymers, rubber, elastomers (e.g., natural or synthetic polymer having elastic properties, such as silicone or any similar materials), and/or combinations thereof. Bent support 34 may be made from a flat sheet metal part, which is then bent before attaching and securing (e.g., via an adhesive, welding) blade 25 on upper portion 39. In examples, the blade 25 may be attached to a top surface 39*a* of the upper portion 39, wherein the top surface 39*a* is adjacent lower surface 28 of blade 25. As shown in FIG. 3, blade 25 may contact top surface 39*a* for a length L1, for example, from about 0.30 mm to about 0.70 mm, or from about 0.40 to about 0.50 mm, or about 0.45 mm, or about 0.46 mm, or about 0.47 mm, or about 0.48 mm, or about 0.49 mm. In other examples, the blade 25 may be attached to a bottom surface 39*b* of the upper portion 39. Flat portion 35 may have a thickness T1 in a Z direction, for example, from about 0.10 to about 0.20 mm, or about 0.12 to about 0.18 mm, or about, 0.13 mm, or about 0.14 mm, or about 0.15 mm, or about 0.16 mm, or about 0.17 mm. Blade 25 may be secured on upper portion 39 of the bent support by any known means, for instance by laser spot welding or by an adhesive.

An angle $\alpha$ between a first plane in which upper portion 39 or blade 25 extends, relative to a second plane in which lower portion 35 extends may be from about 100° to about 150°, from about 110° to about 140°, or from about 120° to about 130° although any other suitable angle is contemplated. Blade 25 and upper portion 39 extend from lower portion 35 in a Z direction, transverse to both the X and Y axes.

Lower portion 35 of bent support 34 may extend longitudinally, parallel to pivot axis X, between two lateral edges 41. Thus, each lateral edge 41 may be substantially perpendicular to pivot axis X. Lower portion 35 may include a bottom edge 42. Bottom edge 42 may extend from one lateral edge 41 to the other lateral edge 41. Bottom edge 42 may be substantially parallel to cutting edge 26 and pivot axis X, and substantially perpendicular to lateral edges 41.

Figure 4:
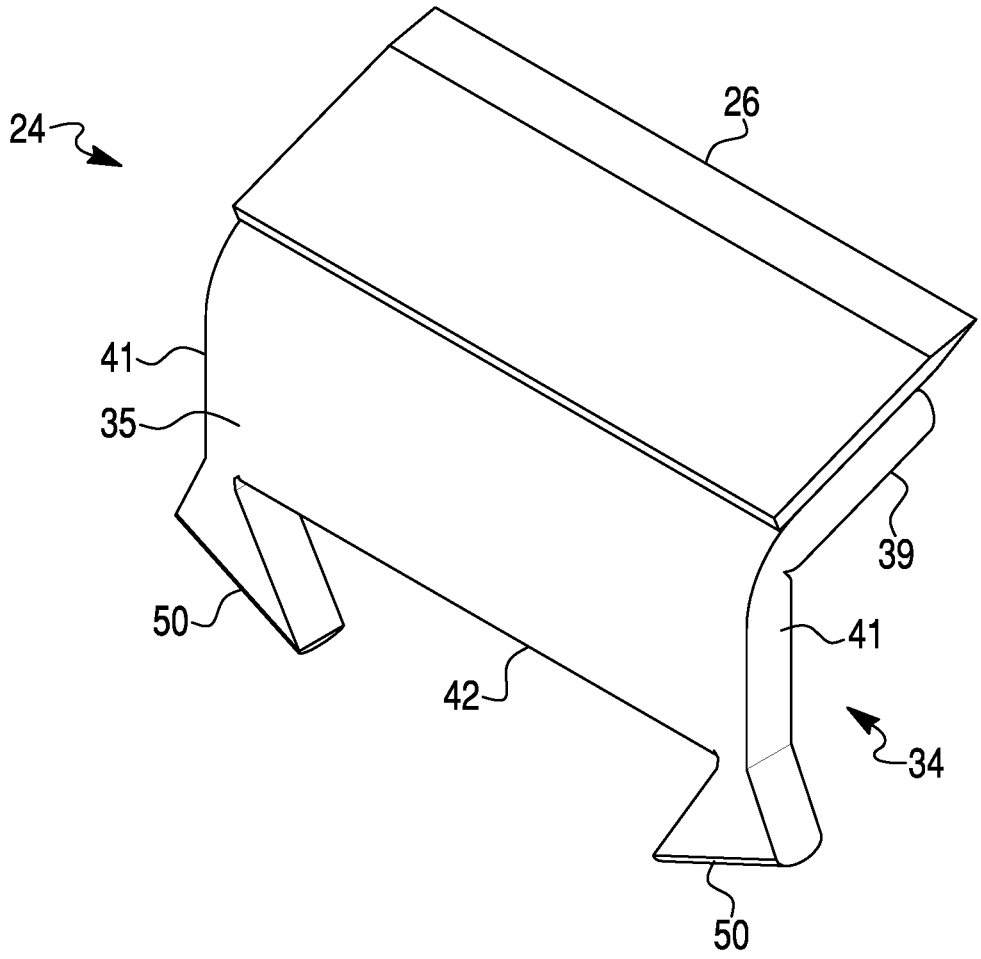
FIG. 4 is a perspective view of an exemplary blade member.
Figure 4A:
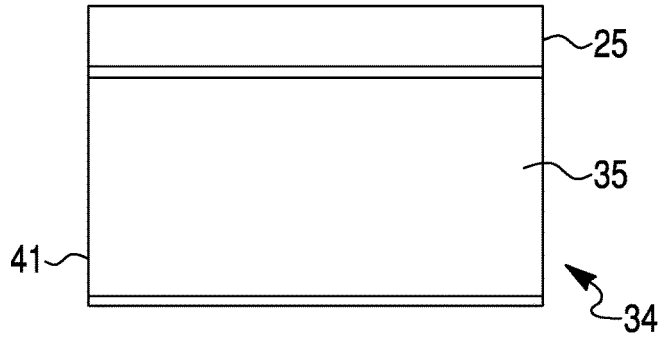
FIGS. 4A-4D illustrate a method of making the blade member of FIG. 4.

In one embodiment, shown in FIG. 4, support 34 may include one or more protrusions 50 (e.g., spring/elastic members) extending away from bottom edge 42. Protrusions 50 may enable blade member 24 to pivot, articulate, and/or move (relative to shaver head frame 10) when blade member 24 is installed in shaver head frame 10. The thickness of protrusions 50 may be adjusted for desired strength, softness, and/or elasticity. For example, thicker protrusions may be generally stronger than thinner protrusions.

In the embodiment shown in FIGS. 4 and 4A-4D, two protrusions 50 extend directly from and are continuous with bottom edge 42. Protrusions 50 also may be located on the opposing lateral ends of bottom edge 42 so that each protrusion 50 is continuous with a lateral edge 41. Thus, protrusions 50 may extend directly from both bottom edge 42 and one lateral edge 41. Protrusions 50 may thus comprise an intersection of lateral edge 41 and bottom edge 42. However, it also is contemplated that protrusions 50 may not be disposed on the opposing lateral ends of bottom edge 42, or that additional protrusions 50 may be disposed elsewhere on support 34. Each of the one or more protrusions is spaced, respectively, from the two lateral edges. For example, one or more protrusions 50 may extend from an interior portion of bottom edge 42 as will be discussed in further detail with respect to FIG. 11. Protrusions 50 may be attached to the support 34. In examples, protrusions 50 may be integral with support 34. That is, in some embodiments, protrusions 50 may not be configured for detachment from the support 34 by a user. However, protrusions 50 may be movable, articulatable, and/or pivotable, relative to the support 34 (such that, when blade members 24 are installed in shaver head frame 10, blade members 24 are able to move and pivot relative to shaver head frame 10).

Protrusions 50 may be formed from a material that is the same as or similar to the material forming support 34. In particular, protrusions 50 may be formed from and directly adjacent to a material that is the same material forming support 34. In some examples, protrusions 50 may be formed from a different material than the material of support 34. Protrusions 50 may also have a same thickness (in the Z direction) as a thickness of support 34. In other examples, protrusion 50 may have a different thickness than the thickness of support 34.

In some embodiments, blade members 24 and protrusions 50 may be received by slots 45. Protrusions 50 may contact surface 45*a* (as best seen in FIG. 2) underneath slots 45, pushing blade members 24 toward a shaving plane. The shaving plane is defined by the shaver head frame 10 and a tangent plane P which is an X-Z plane intersecting the skin-contacting surface of a fin 17 positioned closest to blades 26*a*. Thus, blade members 24 may be secured on one end by surface 45*a*, and on an opposing end by cap 20 or any other similar retaining element. When protrusions of the various disclosed embodiments extend laterally away from lateral edges 41, such protrusions may be received by a slot that is lateral to slots 45 (not shown) disposed within shaver head frame 10. In other embodiments, such as, the embodiment of FIG. 12, various protrusions (e.g., projections 114 and 116) may be received in a slot of support 18*a*. It also is contemplated that blade unit 5 (including shaver head frame 10) itself will not include any elastic or spring-like members that directly contact blade members 24, in some embodiments.

After installation of blade members 24 into shaver head frame 10, in some embodiments, a substantial entirety of protrusions 50 may be fixed relative to shaver head frame 10. Protrusions 50 may be attached to a portion of the blade member 24, wherein protrusions 50 may be movable relative blade member 24. However, because protrusions 50 may be movable relative to the remainder of blade members 24, other portions of blade members 24 may move relative to shaver head frame 10, such as, for example, when blade members 24 and shaver head frame 10 are pressed against the skin of a user. These movable portions may include lower portion 35, upper portion 39, and blade 25. Further discussion of the forces acting on blade member 24 during shaving are discussed below with respect to FIGS. 15 and 16.

Figure 4B:
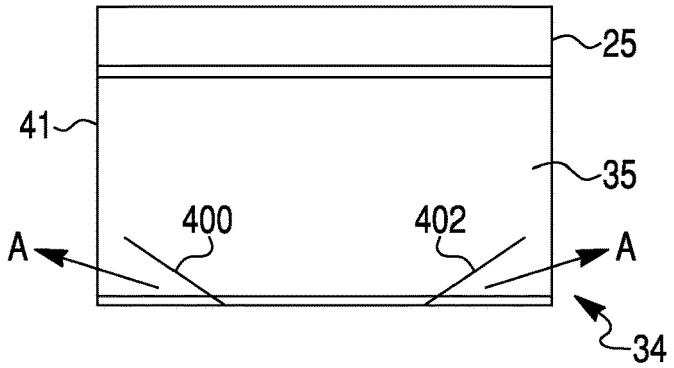
Figure 4C:
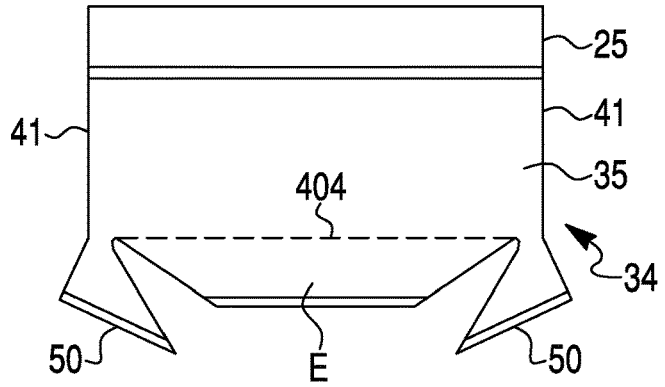
Figure 4D:
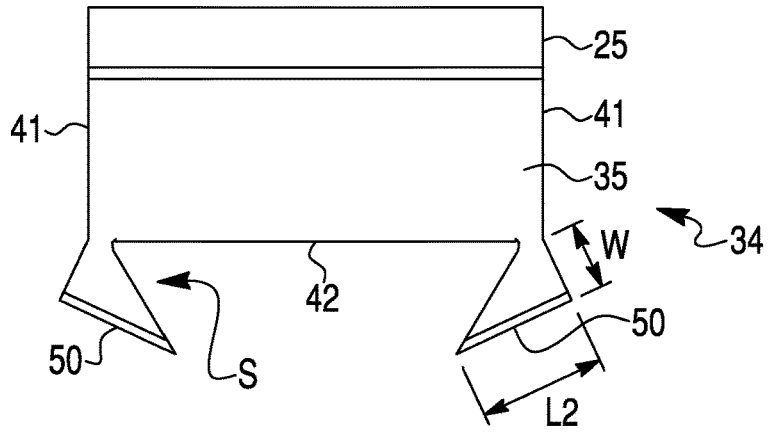

FIGS. 4A-4D illustrate a process for forming protrusions 50 on support 34. While these figures show protrusions 50 being formed after blade 25 is coupled to support 34, it is contemplated that protrusions 50 may be formed before blade 25 is coupled to support 34 and/or before support 34 is formed into its bent profile. In other words, protrusions 50 may be formed on support 34 when support 34 is a flat sheet. On support 34 (FIG. 4A), two cuts 400 and 402 are made through bottom of support 34, and the resulting protrusions 50 are urged/bent away (in the directions of arrows A) from support 34 (FIGS. 4B and 4C). Each of the one or more protrusions 50 is spaced apart from the bottom edge 42. In the particular embodiment shown in FIGS. 4A-4D, protrusions 50 are curved away from support 34 (seen more clearly in FIG. 5). Then, an additional cut is made along line 404 (shown in FIG. 4C) at the bottom of support 34 between the newly formed protrusions 50, and the excess material E is removed to form bottom edge 42. The space S created by this additional cut may help enable blade member 24 to move relative to support 34 when blade member 24 is installed into shaver head frame 10. Furthermore, as shown in FIG. 4D, protrusions 50 may have a width W, for example, from about 0.3 to about 0.9 mm, or from about 0.4 to about 0.8 mm, or about 0.5 mm, or about 0.6 mm, or about 0.7 mm. Protrusions 50 may have a length L2, for example, from about 1.50 mm to about 6.00 mm, or from about 2.50 mm to about 5.00 mm, or from about 3.50 mm to about 4.00 mm, or about 2.43 mm, or about 2.50 mm, or about 2.57 mm.

Figure 5:
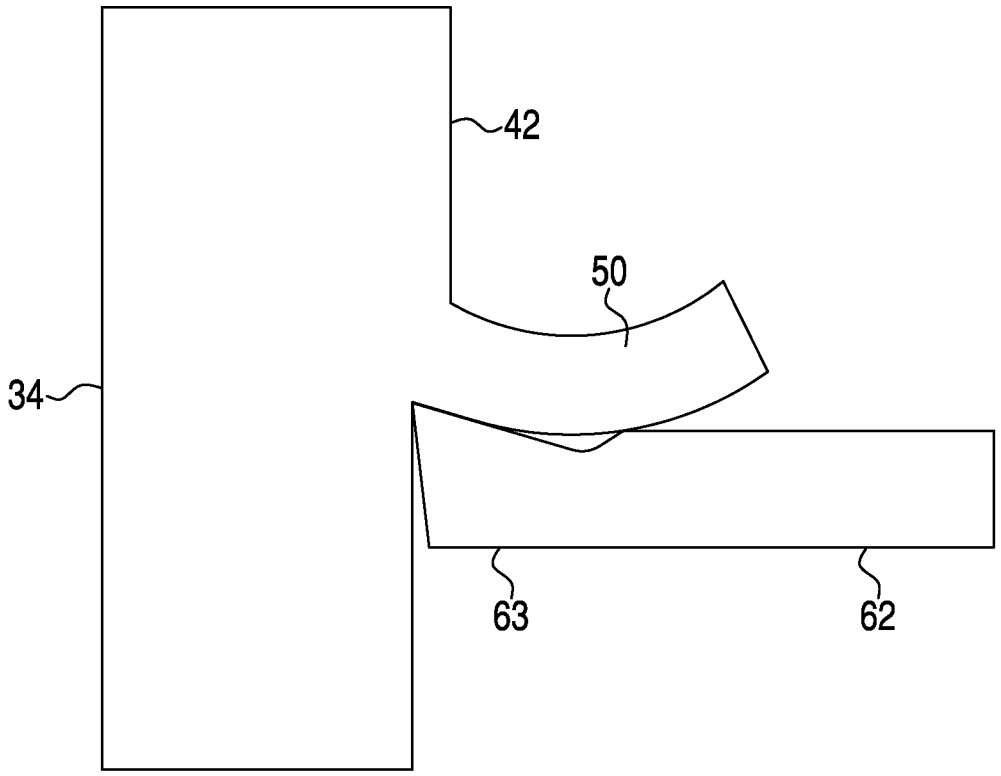
FIG. 5 is an illustration of a portion of the blade member of FIG. 4 and a cutting tool.

As set forth above, protrusions 50 may include a curvature imparted thereon during the formation of protrusions 50. Referring to FIG. 5, bottom of support 34 may be cut using a cutting tool 62 in order to create the desired design of protrusion 50. Cutting tool 62 may include a tip 63 having, for example, a triangle-shaped profile which may aid in forming the curvature of protrusions 50. When used to cut support 34 (e.g., along lines 400 and 402 shown in FIG. 4C), cutting tool 62 can be used to simultaneously cut support 34 (thereby forming the protrusion 50), and also deform the newly-formed protrusions 50 by bending protrusions 50 away from the remaining portions of support 34. Depending on the thickness of the cutting edge of tip 63, the size of the space S between protrusion 50 may vary. In one embodiment, cutting tool 62 is part of a die cutting/forming assembly. However, the cutting step also may be achieved by other mechanisms, such as, e.g., a laser cutting process. In a laser-cutting embodiment, an additional deformation/bending step may be required to move protrusions 50 into a desired position relative to support 34.

Since protrusions 50 may be formed by cutting and bending a portion of support 34, the external surface of each protrusion 50 may have a shape corresponding to the shape of the external surface of support 34. Thus, if support 34 has sharp corners (e.g., formed by a 90-degree intersection of lateral edge 41 and bottom edge 42), protrusions 50 may include such sharp corners. If, on the other hand, support 34 has rounded/curved edges, and protrusions 50 are formed from those edges, the resulting shape of protrusions 50 may be curved/rounded. Similarly, protrusions 50 may have a generally rectangular or triangular shape, or any other suitable shape, based on the shape of the given support 34 from which they are formed.

Figure 6:
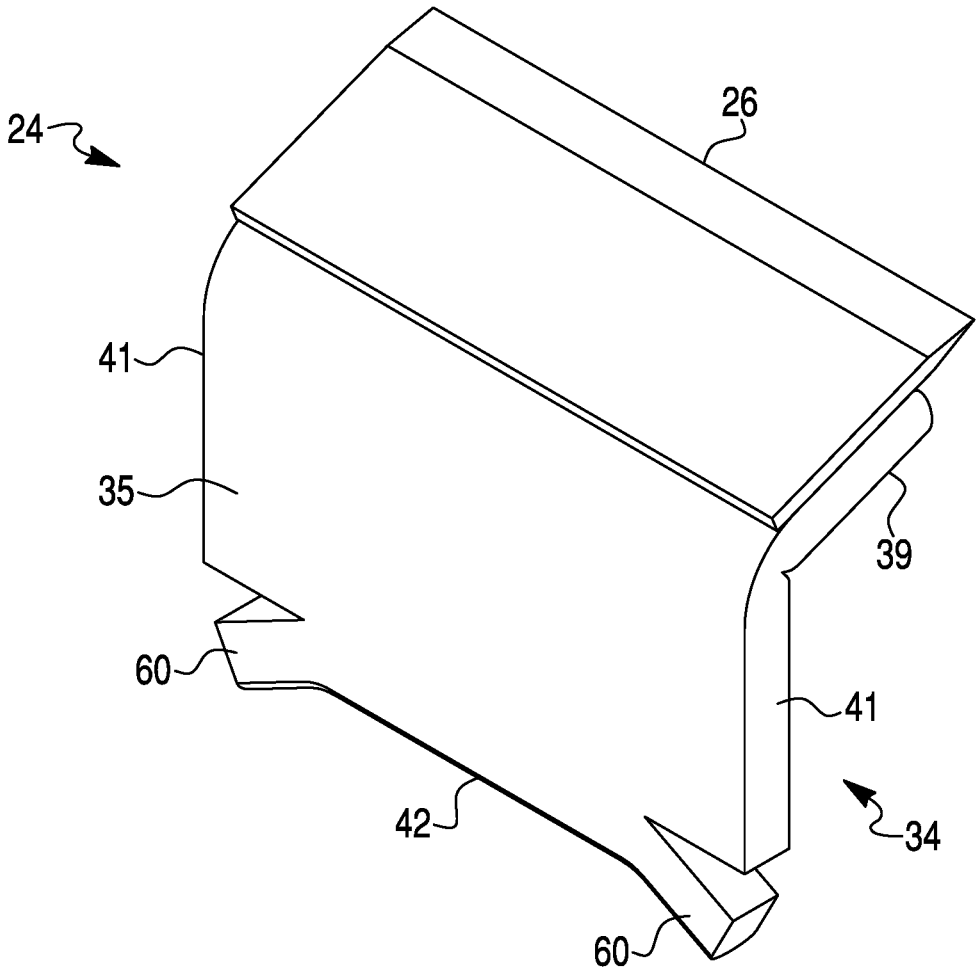
FIG. 6 is a perspective view of another exemplary blade member.
Figure 6A:
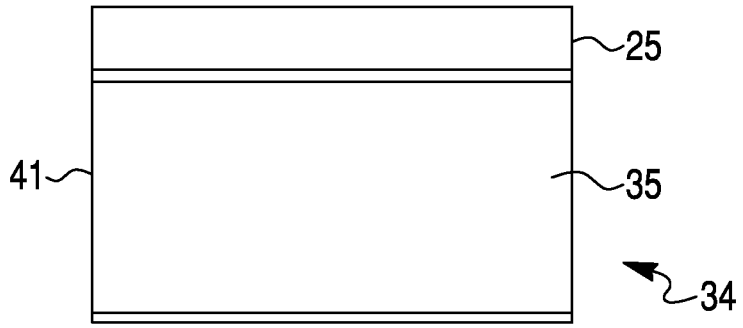
FIGS. 6A-6C illustrate a method of making the blade member of FIG. 6.
Figure 6B:
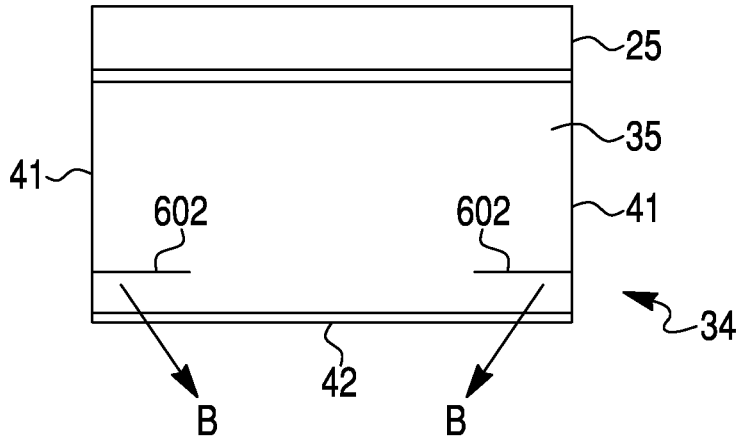
Figure 6C:
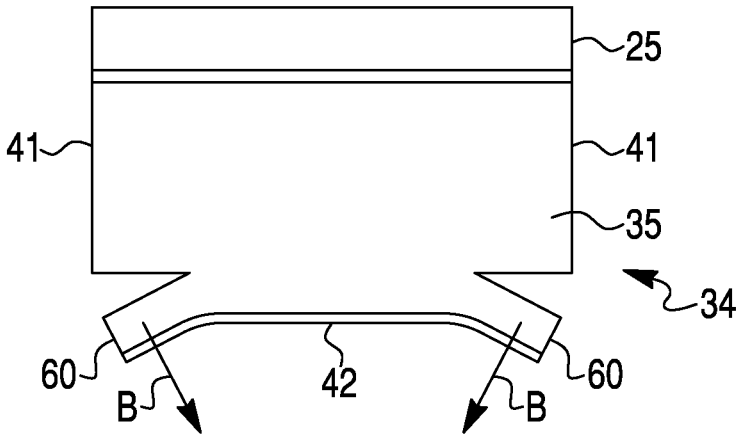
Figure 11A:
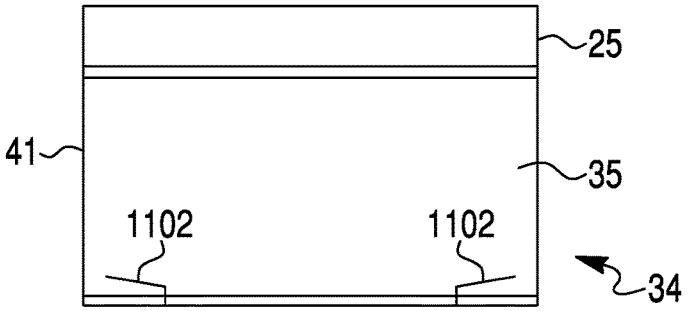
FIGS. 11A-11D illustrate a method of making the blade member of FIG. 11.
Figure 11B:
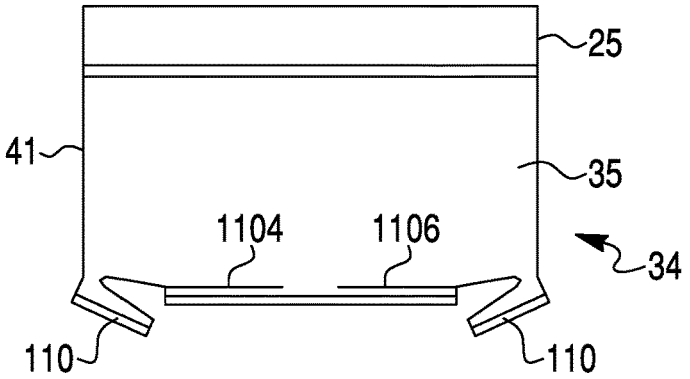
Figure 11C:
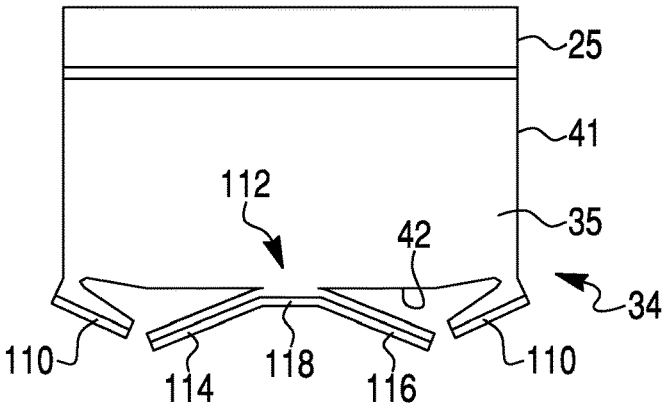
Figure 11D:
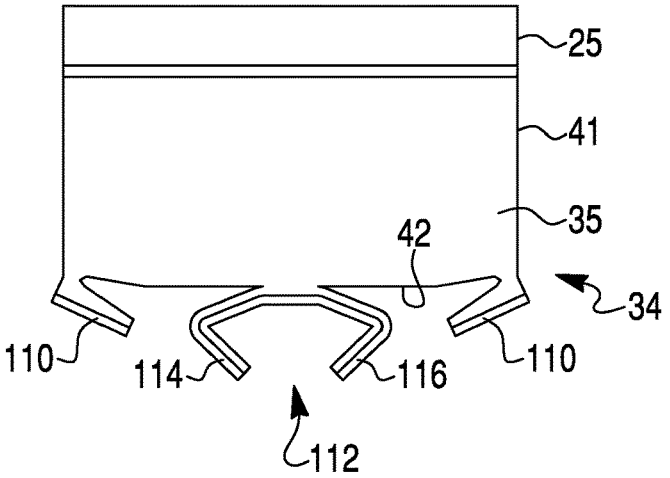
Figure 11E:
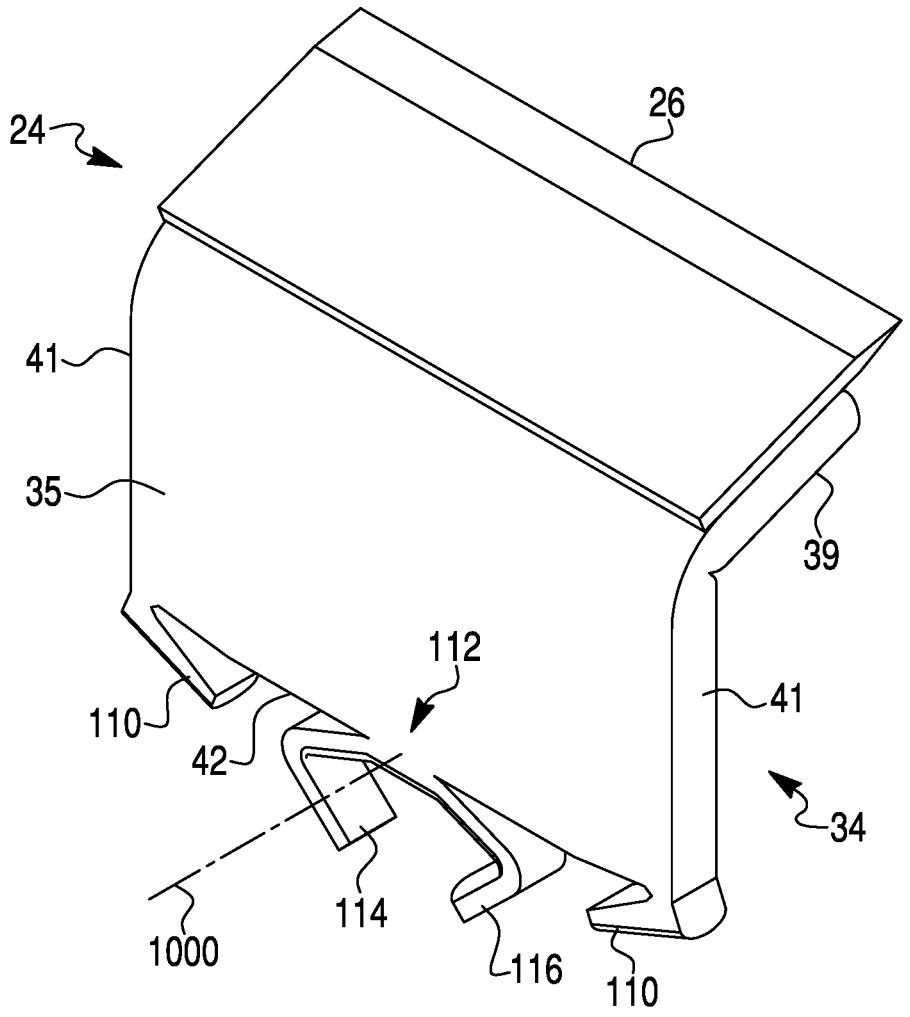
FIG. 11E is a perspective view of another exemplary blade member.

FIG. 6 is a perspective view of blade member 24 having protrusions 60 instead of protrusions 50. In the embodiment shown, two protrusions 60 extend away from and are continuous with bottom edge 42. However, unlike protrusions 50, protrusions 60 do not directly extend from lateral edges 41, and thus, are not continuous with either lateral edge 41 of blade member 24. In other words, protrusions 60 are spaced from a portion of the support 34 such that protrusions 60 extend only from bottom edge 42. FIGS. 6A-6C illustrate a process for forming protrusions 60 on support 34. While these figures show protrusions 60 being formed after blade 25 is coupled to support 34, it is contemplated that protrusions 60 may be formed before blade 25 is coupled to support 34 and/or before support 34 is formed into its bent profile. In other words, protrusions 60 may be formed on support 34 when support 34 is a flat sheet. Two cuts 602 are made through lateral edges 41 in directions substantially parallel to bottom edge 42 (FIG. 6B), and the resulting protrusions 60 are urged away from support 34 (FIG. 6C) in the directions of arrows B.

FIGS. 7 and 7A depict blade member 24 having protrusions 70 that extend from lateral edges 41. In the embodiment shown, each protrusion 70 extends away from and is continuous with one lateral edge 41. In contrast to protrusions 50 and 60, protrusions 70 extend from an upper portion of lateral edge 41 near and adjacent to upper portion 39. FIGS. 8 and 8A depict a similar design as FIGS. 7 and 7A, except blade member 24 includes protrusions 80 disposed at a lower portion of a respective lateral edge 41 near or adjacent to bottom edge 42. The protrusions 70 and 80, in some embodiments, do not extend directly from bottom edge 42. Particularly, the protrusions 70 extend outwardly away from lateral edge 41 so as to have a surface that faces towards upper portion 39. In the embodiments, of FIGS. 4, 6, 7, and 8, high levels of rinsability may be achieved, because the front side and the back side of support 34 is not attached to any supporting member (such as a separate spring finger or elastic element or configuration of shaver head frame 10) that creates an obstacle for shaving debris during rinsing.

FIGS. 9 and 9A depict blade member 24 having a protrusion 90 that extends away from a rear surface 43 of support 34. Rear surface 43 may be disposed in an X-Y plane. Furthermore, rear surface 43 may extend between the two lateral edges 41 of support 34. A front surface 44 also may be disposed in an X-Y plane. Protrusions 90 thus do not extend directly from either lateral edge 41 or bottom edge 42. In the embodiment shown, protrusion 90 is disposed on rear surface 43 at a centered position between lateral edges 41, and also centered between bottom edge 42 and the interface between lower portion 35 and upper portion 39. However, protrusion 90 need not be centered at the location shown in FIG. 9, but rather could be positioned in any other suitable location. Furthermore, a protrusion 90*a* also may be disposed on front surface 44 of blade member 24 (see FIG. 9A). In some embodiments, one or more blade members 24 may include a protrusion 90 extending from rear surface 43 of the respective blade members 24, while one or more other blade members 24 may include a protrusion 90*a* that extends from front surface 44 of the respective blade members 24. It is contemplated that additional numbers of protrusions 90 or 90*a* may extend from rear surface 43 or front surface 44. For example, two, three, four, or more protrusions 90/90*a* may extend from rear surface 43 or front surface 44. Protrusions 90/90*a* may also be arranged in any suitable configuration on rear surface 43 or front surface 44. For example, when two protrusions 90/90*a* are utilized, each of the two protrusions 90/90*a* may be disposed at or adjacent to lateral edges 41 and/or bottom edge 42 (instead of being centered as shown). In other examples, protrusions 90/90*a* may be disposed at or adjacent the upper portion of support 34 (i.e., closer to upper portion 39). It is further contemplated that a given blade member 24 may include protrusions 90/90*a* on both rear surface 43 and front surface 44 in any of the quantities, combinations, and patterns set forth above. Protrusions 90/90*a* may be relatively thin and may bend when a force is applied against blade members 24.

FIG. 10 depicts blade member 24 with a flexible material 100 disposed along at least a portion of lower portion 35 and is parallel to and forms at least a portion of bottom edge 42. In some embodiments, flexible material 100 may extend along an entirety or a substantial entirety of bottom edge 42. In other embodiments, interrupted portions of flexible material 100 may be disposed along bottom edge 42. In still other embodiments, flexible material 100 may be disposed along one or more of lateral edges 41. Flexible material 100 may provide blade member 24 with a similar pivoting or articulating function as the protrusions 50, 60, 70, 80, 90 discussed above.

In this embodiment, support 34 may be formed of metal (e.g., stainless steel), or any of the other aforementioned materials, while flexible material 100 may include rubber or polymeric material having a higher elasticity than the material of support 34. Instead of rubber, any thermoplastic elastomer or silicone (polysiloxane) material may be also used as a flexible material. The flexible material does not comprise any additional features in some embodiments. The flexible material may be formed on at least a portion of the bottom surface 42 of the support 34 and, due to its elasticity, may provide the movement of the blade members 24, for example, by pushing against surface 45*a* shown in FIG. 2. Flexible material 100 may be attached to support 34 by an overmolding process. For example, support 34 may be machined, cast, or otherwise formed. Then, support 34 may be inserted into an injection molding tool, and the rubber or polymer may be molded onto or around support 34. Alternatively, any rubber or polymer material can be adhered to support 34 with the use of an adhesive, glue, or the like. To apply flexible material 100 to support 34 via adhesive may include the steps of 1) rubbing the metal surface of support 34 to give the surface texture, 2) cleaning the surfaces of both support 34 and flexible material 100 (e.g., the rubber) to remove dirt and dust, and 3) applying the adhesive or glue to both support 34 and flexible material 100 in a relatively thin coating.

FIGS. 11 and 11A-11D show blade member 24 with protrusions 110, and projections 114 and 116, of differing elasticities positioned along bottom edge 42. For example, more than one type of protrusion, such as for example, more than one spring or a combination of protrusions and springs may be located at and/or along bottom edge 42. This arrangement may provide a small rotation of blade member 24 about a pivot axis 1000. Pivot axis 1000 extends along and/or is parallel to the Z axis. Thus, in this embodiment, blade member 24 may be configured to rotate, tilt, or rock about pivot axis 1000 in a reciprocal manner.

For example, two protrusions 110 may be disposed along bottom edge 42. Protrusions 110 may be substantially similar to protrusions 50 or 60 described above. The embodiment of FIG. 11 also depicts an elastic region 112 having a first projection 114 and a second projection 116. First projection 114 and second projection 116 may articulate and move relative to bottom edge 42 in a similar manner as any of the protrusions set forth above. However, since projections 114 and 116 are positioned relatively close to one another, when blade member 24 is installed into shaver head frame 10, together, the combination of projections 114 and 116 (elastic region 112) functions as a relatively stiff structure. In some examples, support 34 does not include elastic region 112 directly coupled to any portion of support 34.

Protrusions 110 may be formed in the same manner as the protrusions set forth above. For example, referring to FIG. 11A, a cutting tool may be used to cut support 34 along cut lines 1102. Elastic region 112 may be formed by cutting support 34 along cut lines 1104 and 1106 shown in FIG. 11B. Elastic region 112 may be stiffer, stronger, and have a larger spring force, than each individual protrusion 110, due to the presence of the two projections 114 and 116, as opposed to the single arm of protrusions 110. In addition, each projection 114 and 116 may have a larger thickness than each of protrusions 110 (shown explicitly in FIG. 11E), again making each projection 114 and 116 (and the combined elastic region 112) stiffer, stronger, and having a larger spring force. The effect of having elastic region 112 stiffer than protrusions 110 may help provide a better rotation/movement of blade member 24 about pivot axis 1000 while shaving. In other examples, protrusions 110 may have a larger thickness than the two projections 114/116. It is also perceivable that there may be combinations of thicknesses wherein the protrusions 110 may have one thickness and the two projections 114/116 may each have different thicknesses as well as may have thicknesses different (larger, smaller than or equivalent to) one another and/or thicknesses different (larger, smaller than or equivalent to) protrusions 110.

Yet another embodiment is shown in FIGS. 12 and 12A, where blade member 24 includes protrusions 120 that are substantially similar to protrusions 70 set forth above. However, in this embodiment, the lower portions of both lateral edges 41 include a curvature or rounding 1242. The presence or curvature 1242 on both lateral edges 41 may facilitate a small rotation of blade member 24 about pivot axis 1100 during shaving, in a similar manner as discussed above with respect to FIG. 11. The radius of curvature of curvature 1242 may be, for example, from 0.20 to 1.70 mm, or from about 0.50 mm to about 1.40 mm, or from about 0.80 mm to about 1.10 mm, or about 0.85 mm, or about 0.90 mm, or about 0.95 mm, or about 1.00 mm, or about 1.05 mm.

Figure 13:
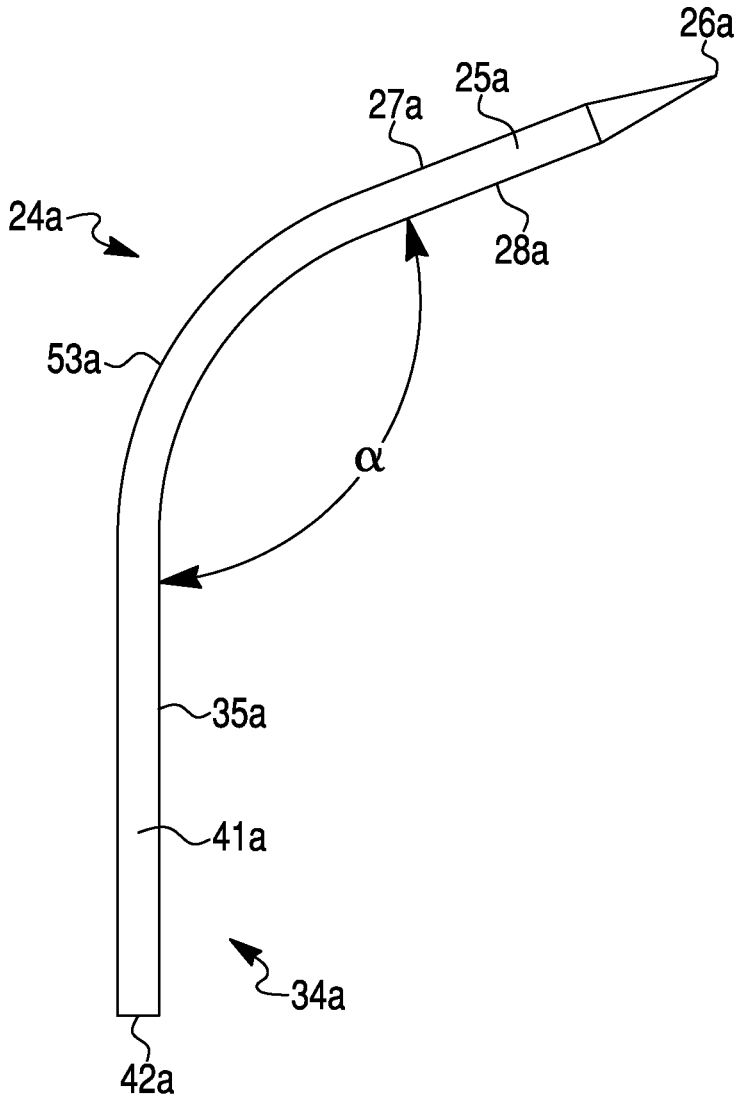
FIG. 13 is a side view of another exemplary blade member.

FIG. 13 depicts an integrally-formed bent blade member 24*a*, i.e., a blade member comprising the blade and the support in one piece. Blade member 24*a* may be movably mounted in blade receiving section 13 of shaver head frame 10. Blade member 24*a* may include a blade 25*a* with a cutting edge 26*a* oriented forward in the direction of shaving. Each blade 25*a* may include an upper face 27*a* oriented towards the skin to be shaved and an opposing lower face 28*a* oriented toward handle 2. The upper and lower faces 27*a*, 28*a* of the blade 25*a* may be substantially parallel to one another, and may taper towards cutting edge 26*a*.

Figure 14:
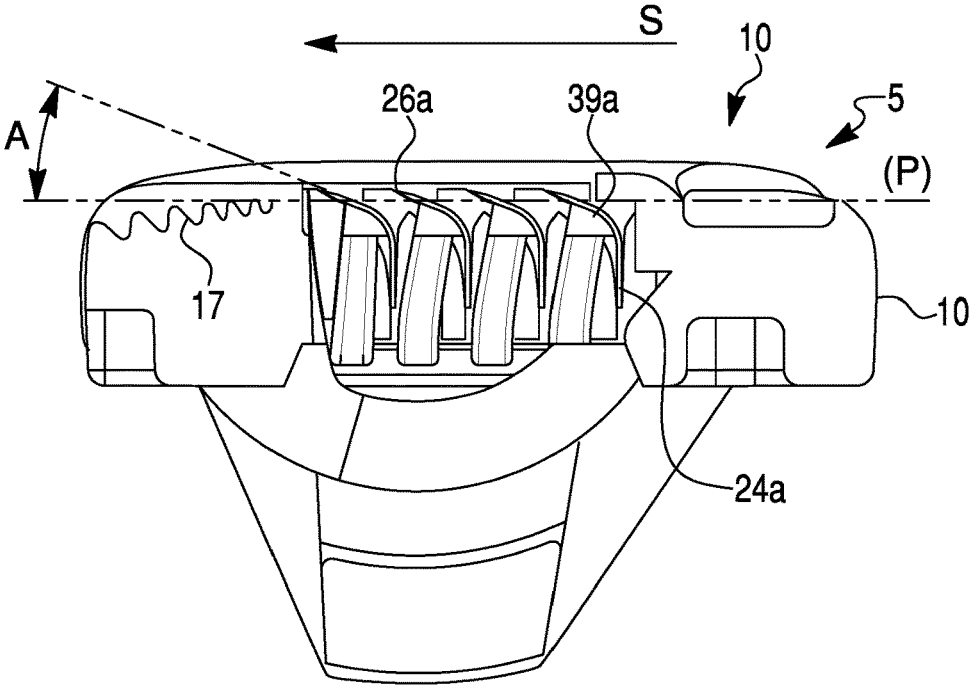
FIG. 14 is a cross-sectional view of a shaver head, comprising the blade member of FIG. 13.

Each blade 25*a* extends longitudinally, parallel to pivot axis X. Each blade 25*a* may be integrally formed with a lower portion 35*a* (i.e., formed from the same sheet of material in a one-piece configuration). Blade member 24*a* may include a bent profile, lower portion 35*a* is substantially flat and perpendicular to reference plane P (as shown in FIG. 14), blade 25*a*, and a bent portion 53*a* that connects blade 25*a* and lower portion 35*a*. Bent portion 53*a* may include a concave outer face and a concave inner face.

An angle $\alpha$ between a first plane in which blade 25*a* extends, relative to a second plane in which lower portion 35*a* extends may be from about 100° to about 150°, from about 110° to about 140°, or from about 120° to about 130°, although any other suitable angle is contemplated.

Lower portion 35*a* may extend longitudinally, parallel to pivot axis X, between two lateral edges 41*a*. Thus, each lateral edge 41*a* may be substantially perpendicular to pivot axis X. A bottom edge 42*a* may extend from one lateral edge 41*a* to the other lateral edge 41*a*. Bottom edge 42*a* may be substantially parallel to cutting edge 26*a* and pivot axis X, and substantially perpendicular to lateral edges 41*a*.

Blade member 24*a* may include any of the protrusions or flexible materials discussed above with reference to blade member 24, and such features may be positioned in similar or corresponding locations on blade member 24*a*. For example, protrusions 50, 60, 70, 80, 90, 90*a*, 110, and/or 120, and/or projections 114 and 116, may be disposed in corresponding locations of blade member 24*a* as they are described above with reference to blade member 24. Alternatively, blade member 24*a* may include a flexible material 100 as described above. Still further, blade member 24 may include curved portions 1242 between lateral edges 41*a* and bottom edge 42*a*.

Referring to FIG. 14, cutting edge 26*a*, may be oriented forward in the direction of shaving represented by arrow S.

In particular, cutting edges 26*a* may be oriented to face toward fins 17. Cutting edge 26*a* may be accessible through blade receiving section 13, to cut hair. Although FIG. 14 shows integrally formed bent blade member 24*a*, blade members comprising blades attached to a support may also be foreseen.

Cutting edge 26 of all blade members 24 may be positioned substantially parallel to each other. Cutting edges 26 of blades 25 extend from the interior of shaver head frame 10, through tangent plane P (see FIG. 14). In other words, the blades 25*a* have a positive exposure wherein cutting edges 26*a* extend above plane P.

As described in further detail below, each blade member 24 (or blade member 24*a*) includes either protrusions or flexible material to help facilitate movement of the respective blade members 24 within shaver head frame 10. Furthermore, lower portions 35 of blade members 24 may be slidingly guided into slots 45. Slots 45 may extend along the Y axis and are, for example, substantially perpendicular to the tangent plane P.

Blade members 24 are elastically biased by the protrusions or flexible material toward a nominal position. In this nominal position, the outer faces 27 of blade 25, and more precisely cutting edge 26, at each lateral end of blade 25, bear against corresponding upper stop portions 52 (referring to FIG. 2) which are, for example, provided on the bottom stopping face of each side member 21, the side members 21 covering slots 45. In the nominal position, an angle A (also called shaving angle) may be measured between the first plane containing upper portion 39 or blade 25, and the tangent plane P defined by the front guard and the rear cap above-mentioned.

Figure 15:
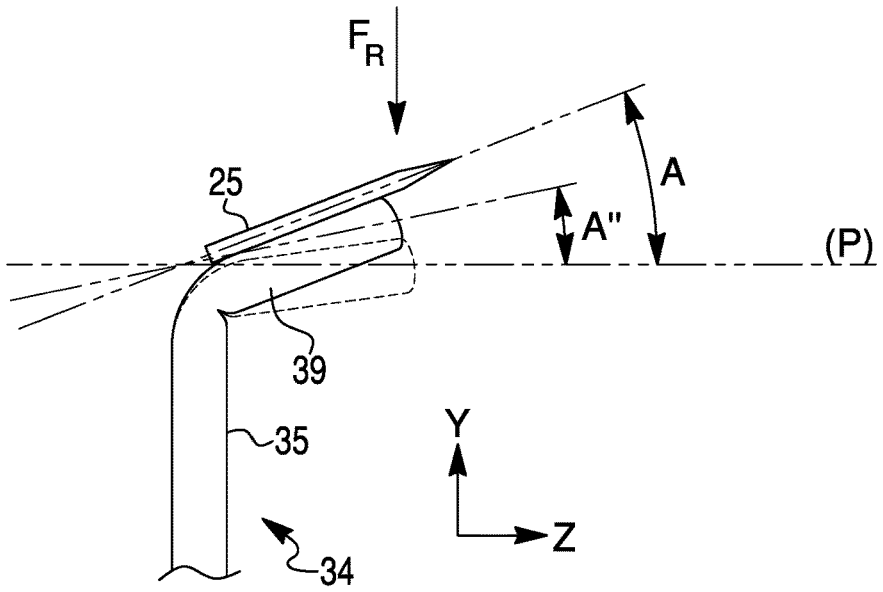
FIGS. 15 and 16 are schematic views of the blade member of FIG. 3 in different positions.

During shaving, the user contacts the razor head with his/her skin. As shown in FIG. 15, the angle A" measured between the first plane and the tangent plane, when the shaver head is contacting the skin of the user and before any movement, is different than the angle A measured between the first plane and the tangent plane in the nominal position. Indeed, a force will be applied to blade 25 by the user, along a direction $F_R$ in the Y direction (see FIG. 15), which is substantially perpendicular to tangent plane P to achieve the contact between the skin and blades 25.

Upon shaving, a force Fs (see FIG. 16) also will be applied to blades 25 along a direction Fs in the Z direction, which is substantially parallel to tangent plane P. Blades 25 are guided for movement in a direction perpendicular to the tangent plane through the slots 45.

Referring back to FIG. 2, the shape of blade members 24 and their placement inside the slot 45 may allow for a degree of rotational movement of blades 25 relative to handle 2. In other words, the entirety of blade member 24 rotates with slots 45 during shaving. The rotation tends to increase the shaving angle. Although FIG. 2 shows blade members comprising blades attached to a support, integrally formed bent blade members may also be foreseen.

Moreover, the shape of blade members 24 and their placement inside slots 45 also allows a deflection of blade members 24 (i.e., an elastic deformation of blade member 24 itself). More precisely, the shape of bent support 34 and its placement inside slot 45 may allow a movement of cutting edge 26 with regard to the base 35, such as shown in FIG. 16.

Under a force applied along the direction $F_S$ (along the Z axis), blade members 24 may move toward the bottom of frame 10. At the same time, blade member 24 rotates with slot 45, and there is a deflection of cutting edge 26 relative to lower portion 35. Thus, the angle between the upper portion 39 and the lower portion 35 increases.

Since the force applied to blade 25 is different in a position when the shaver 1 contacts the skin without moving (also called a rest position) and a movable position during shaving (also called a shaving position), the rotation of cutting edge 26 is different. In the shaving position, the rotation increases the nominal shaving angle.

Figure 16:
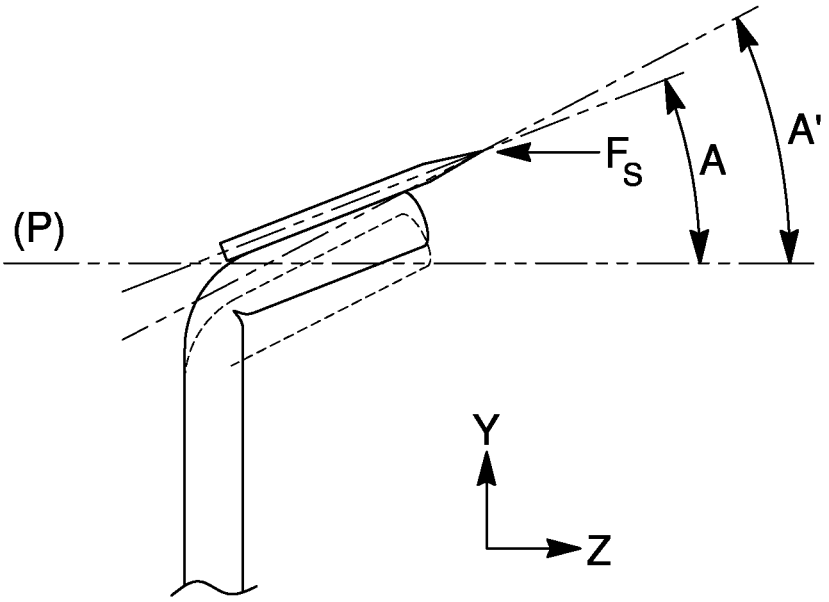

Referring to FIG. 16, the blade 25 with a full line is blade 25 in the nominal position whereas blade 25 with dashed line represents blade 25 in the shaving position. In the nominal position, the angle A between the first plane and tangent plane P is lower than the angle A' between the first plane and tangent plane P in the shaving position.

All technical and scientific terms used herein have the same meaning as commonly understood to one of ordinary skill in the art to which this disclosure belongs unless clearly indicated otherwise. As used herein, the singular forms "a", "an", and "the" include plural references unless the context clearly dictates otherwise. Thus, for example, reference to "a blade" may include a plurality of such blades and reference to "the blade" may include reference to one or more blades and equivalents thereof known to those skilled in the art, and so forth.

As is evident from the figures and text presented above, as well as the examples below, a variety of embodiments are contemplated:

Embodiment 1. A shaving blade member, comprising: an upper portion disposed in a first plane, wherein an end of the upper portion includes a tapered cutting edge; a lower portion extending from the upper portion and disposed in a second plane, the second plane being at an angle with the first plane; wherein the lower portion comprises one or more protrusions, the one or more protrusions being movable relative to the lower portion.

Embodiment 2. The shaving blade member of Embodiment 1, wherein one or more of the protrusions are integrally formed with the lower portion.

Embodiment 3. The shaving blade member of Embodiment 1 or Embodiment 2, wherein one or more of the protrusions are made of the same material as the lower portion.

Embodiment 4. The shaving blade member of any of the preceding Embodiments, wherein: the lower portion includes two lateral edges and a bottom edge disposed between the two lateral edges; and the one or more protrusions extend directly from the bottom edge and away from the bottom edge.

Embodiment 5. The shaving blade member of Embodiment 4, wherein each of the one or more protrusions is spaced, respectively, from the two lateral edges.

Embodiment 6. The shaving blade member of Embodiment 4 or Embodiment 5, further including an elastic region extending from the bottom edge wherein the elastic region is stiffer than the one or more protrusions.

Embodiment 7. The shaving blade member of Embodiment 6, wherein the one or more protrusions include two protrusions positioned at opposing lateral ends of the bottom edge.

Embodiment 8. The shaving blade member of Embodiment 6 or Embodiment 7, wherein the elastic region includes two projections extending away from the bottom edge.

Embodiment 9. The shaving blade member of Embodiment 8, wherein each of the two projections of the elastic region has a thickness greater than a thickness of each of the two protrusions positioned at opposing lateral ends of the bottom edge.

Embodiment 10. The shaving blade member of any one of Embodiments 1-3, wherein: the lower portion includes two lateral edges and a bottom edge disposed between the two lateral edges, and each of the one or more protrusions extends directly from one lateral edge, and extends laterally away from the one lateral edge.

Embodiment 11. The shaving blade member of Embodiment 10, wherein each of the one or more protrusions is spaced apart from the bottom edge.

Embodiment 12. The shaving blade member of any of the preceding Embodiments, wherein: the lower portion includes two lateral edges, a bottom edge disposed between the two lateral edges, and a front surface and a rear surface partially bounded by the two lateral edges and the bottom edge; and at least one of the one or more protrusions extends from the front surface or the rear surface.

Embodiment 13. The shaving blade member of any of the preceding Embodiments, wherein the upper portion includes a flat support and a straight blade coupled to the flat support, wherein the blade includes the tapered cutting edge.

Embodiment 14. The shaving blade member of any of the preceding Embodiments, wherein an entirety of the upper portion and an entirety of the lower portion are formed from a same sheet of material.

Embodiment 15. The shaving blade member of any of the preceding Embodiments, wherein the angle between the first plane and the second plane is from 100° to 150°.

Embodiment 16. A shaving blade member, comprising:

an upper portion disposed in a first plane, wherein an end of the upper portion includes a tapered cutting edge; a lower portion extending from the upper portion and disposed in a second plane being at an angle with the first plane, the lower portion including a bottom edge that is substantially parallel to the tapered cutting edge, wherein the lower portion is formed from a first material; and a second material extending along at least a portion of the bottom edge, wherein the second material has a greater elasticity than the first material.

Embodiment 17. The shaving blade member of Embodiment 16, wherein the first material is metal, and the second material is a rubber or a polymer.

Embodiment 18. The shaving blade member of Embodiment 16 or Embodiment 17, wherein the second material extends along an entirety of the bottom edge.

Embodiment 19. A shaver, comprising: a handle; a head coupled to the handle, wherein the head comprises a frame; and one or more shaving blade members coupled to the frame, wherein each of the one or more shaving blade members includes: an upper portion disposed in a first plane, wherein an end of the upper portion includes a tapered cutting edge; and a lower portion extending from the upper portion and disposed in a second plane being at an angle with the first plane; and one or more protrusions that are movable relative to the lower portion, the one or more protrusions are configured to be coupled to the frame, such that the upper portion and the lower portion are movable relative to the frame once the protrusions are coupled to the frame.

Embodiment 20. The shaver of Embodiment 19, wherein: the one or more protrusions are configured to bias a respective shaving blade member into a first position; and upon application of a force on the respective blade member, the upper portion and the lower portion of the respective shaving blade member are moved relative to the frame and relative to the one or more protrusions, and upon release of the force on the respective shaving blade member, the respective shaving blade member returns to the first position.

The above description is illustrative and is not intended to be restrictive. One of ordinary skill in the art may make numerous modifications and/or changes without departing from the general scope of the disclosure. For example, and as has been described, the above-described embodiments (and/or aspects thereof) may be used in combination with each other. Additionally, portions of the above-described embodiments may be removed without departing from the scope of the disclosure. In addition, modifications may be made to adapt a particular situation or material to the teachings of the various embodiments without departing from their scope. Many other embodiments will also be apparent to those of skill in the art upon reviewing the above description.

What is claimed is:

1. A shaving blade member, comprising:

a blade disposed in a first plane, wherein an end of the blade includes a tapered cutting edge;

a blade support extending from the blade and disposed in a second plane being at an angle with the first plane, the blade support including a bottom edge that is substantially parallel to the tapered cutting edge, wherein the blade support is formed from a first material; and a second material integrally formed with at least a portion of the bottom edge, wherein the second material has a greater elasticity than the first material.

2. The shaving blade member of claim 1, wherein the first material is metal, and the second material is a rubber or a polymer.

3. The shaving blade member of claim 1, wherein the second material is integrally formed with an entirety of the bottom edge.

4. The shaving blade member of claim 1, wherein the second material is formed on at least a portion of the bottom edge via an adhesive.

5. The shaving blade member of claim 1, wherein the second material is overmolded onto at least a portion of the bottom edge.

6. The shaving blade member of claim 1, wherein the blade support further includes a first lateral edge and a second lateral edge, wherein the first lateral edge and the second lateral edge are substantially perpendicular to the bottom edge, and wherein the second material is formed on at least a portion of the first lateral edge and/or at least a portion of the second lateral edge.

7. The shaving blade member of claim 1, wherein a length of the second material is parallel to a length of the bottom edge.

8. The shaving blade member of claim 1, wherein a thickness of the second material in a shaving direction is the same as a thickness of the blade support in the shaving direction.

9. The shaving blade member of claim 8, wherein the second material is integrally formed with an entirety of the bottom edge of the blade support.

10. A shaving blade member, comprising:

a blade disposed in a first plane, wherein an end of the blade includes a tapered cutting edge;

a blade support extending from the blade and disposed in a second plane being at an angle with the first plane, the blade support including a bottom edge that is substantially parallel to the tapered cutting edge, wherein the blade support is formed from a first material; and a second material extending along a substantial entirety of the bottom edge, wherein the second material has a greater elasticity than the first material.

11. The shaving blade member of claim 10, wherein a length of the second material is parallel relative to the bottom edge.

12. The shaving blade member of claim 10, wherein a thickness the second material in a shaving direction is the same as a thickness of the blade support in the shaving direction.

13. A shaving blade member, comprising:

a blade disposed in a first plane, wherein an end of the blade includes a tapered cutting edge;

a blade support extending from the blade and disposed in a second plane being at an angle with the first plane, the blade support including a bottom edge that is substantially parallel to the tapered cutting edge, wherein the blade support is formed from a first material; and a second material extending along at least a portion of the bottom edge, wherein the second material has a greater elasticity than the first material and the second material is configured to remain attached to the bottom edge upon removal of the shaving blade member from a shaver head.

14. The shaving blade member of claim 13, wherein the second material extends along an entirety of the bottom edge of the blade support.

15. The shaving blade member of claim 13, wherein a length of the second material is parallel relative to the bottom edge.

16. The shaving blade member of claim 13, wherein a thickness the second material in a shaving direction is the same as a thickness of the blade support in the shaving direction.

* * * * *